US009346650B2

(12) United States Patent
Niizeki

(10) Patent No.: US 9,346,650 B2
(45) Date of Patent: May 24, 2016

(54) SPOOL HOLDER AND SEWING MACHINE

(71) Applicant: BROTHER KOGYO KABUSHIKI KAISHA, Nagoya, Aichi (JP)

(72) Inventor: Tomoyasu Niizeki, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/626,319

(22) Filed: Feb. 19, 2015

(65) Prior Publication Data

US 2015/0239707 A1 Aug. 27, 2015

(30) Foreign Application Priority Data

Feb. 27, 2014 (JP) ..... 2014-036677

(51) Int. Cl.
*D05B 43/00* (2006.01)
*D05B 91/14* (2006.01)
*B65H 49/16* (2006.01)

(52) U.S. Cl.
CPC ..... *B65H 49/16* (2013.01); *D05B 43/00* (2013.01); *D05B 91/14* (2013.01); *B65H 2701/31* (2013.01)

(58) Field of Classification Search
CPC ..... D05B 43/00; D05B 72/02; D05B 77/00; D05B 91/14; D05B 91/16; B65H 49/16; B65H 49/32; B65H 49/321; B65H 49/327; B65H 49/36; B65H 75/185; D02G 3/46
See application file for complete search history.

(56) References Cited

U.S. PATENT DOCUMENTS

| | | | | | |
|---|---|---|---|---|---|
| 2,900,941 | A * | 8/1959 | Platt | D05B 43/00 | 112/258 |
| 3,381,641 | A * | 5/1968 | Bialy | D05B 43/00 | 112/302 |
| 3,444,833 | A * | 5/1969 | Blackwood | D05B 43/00 | 112/270 |
| 3,665,875 | A * | 5/1972 | Bantor | D05B 59/00 | 112/279 |
| 4,183,313 | A * | 1/1980 | Odermann | D05B 51/00 | 112/302 |
| 4,651,662 | A * | 3/1987 | Brauch | D05B 73/00 | 112/258 |
| 6,044,782 | A * | 4/2000 | Fressemann | D05B 43/00 | 112/168 |
| 7,114,455 | B2 * | 10/2006 | Prufer | D05B 43/00 | 112/258 |

FOREIGN PATENT DOCUMENTS

| | | | |
|---|---|---|---|
| FR | 2280737 | A1 * | 2/1976 |
| JP | H08-98977 | A | 4/1996 |

* cited by examiner

*Primary Examiner* — Ismael Izaguirre
(74) *Attorney, Agent, or Firm* — Oliff PLC

(57) ABSTRACT

A spool holder on which a thread spool is placeable includes an engagement part detachably engaging a mount which is located on an arm of a sewing machine. In the spool holder, a support located on a rear end of a cover member is detachably attached to the mount. The cover member covers an upper side of a front of the arm and a front side of an upper surface of the arm so that the cover member is capable of opening and closing the upper side of the front of the arm and the front side of the upper surface of the arm. The spool holder is attached to the sewing machine by inserting the engagement part rearward from a front side of the sewing machine into the mount from which the cover member has been detached.

7 Claims, 12 Drawing Sheets

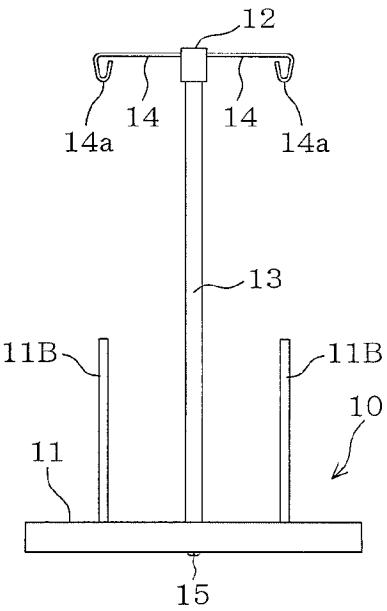
FIG. 4A
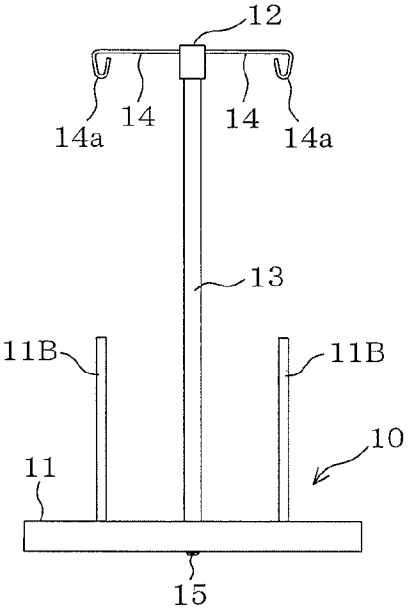
FIG. 4B
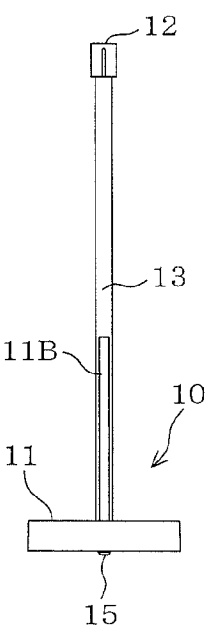
FIG. 4C
FIG. 4D
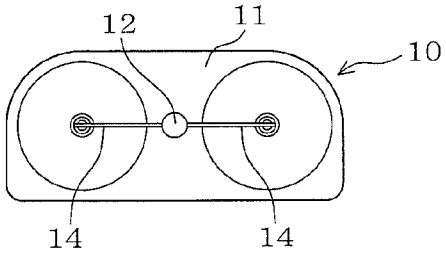
FIG. 4E
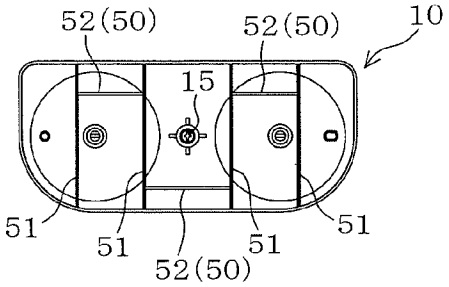
FIG. 4F

SPOOL HOLDER AND SEWING MACHINE

CROSS-REFERENCE TO RELATED APPLICATIONS

This application is based upon and claims the benefit of priority from the prior Japanese Patent Application No. 2014-036677 filed on Feb. 27, 2014, the entire contents of which are incorporated herein by reference.

BACKGROUND

1. Technical Field

The present disclosure relates to a spool holder capable of holding thread spools and a sewing machine to which the spool holder is detachably attached.

2. Related Art

A detachable spool holder has conventionally been known which is hooked on a handle of a sewing machine thereby to be attached to the sewing machine. The spool holder of this type includes a locking part having a distal end inserted into a gap between a sewing machine frame and the handle, thereby being attached to the sewing machine.

SUMMARY

The gap between the sewing machine frame and the handle is located in an upper rear of the sewing machine and is hard for a user operating the sewing machine to view. Accordingly, when attaching the spool holder to the sewing machine, the user needs to take such a position as to be able to view the gap in the upper rear of the sewing machine or to move to a position where the user can reliably view the gap. This results in cumbersome attaching/detaching operation of the spool holder.

Therefore, an object of the disclosure is to provide a spool holder which can improve the operability in attaching/detaching operation thereof and a sewing machine to which the spool holder is detachably attached.

The disclosure provides a spool holder on which a thread spool is placeable, including an engagement part detachably engaging a mount which is provided on an arm of a sewing machine, wherein a support provided on a rear end of a cover member is detachably attached to the mount, the cover member covering an upper side of a front of the arm and a front side of an upper surface of the arm so that the cover member is capable of opening and closing the upper side of the front of the arm and the front side of the upper surface of the arm and wherein the spool holder being attached to the sewing machine by inserting the engagement part rearward from a front side of the sewing machine into the mount from which the cover member has been detached.

The disclosure also provides a sewing machine including a spool holder on which a thread spool is placeable, the spool holder including an engagement part detachably engaging a mount which is provided on an arm of a sewing machine, wherein a support provided on a rear end of a cover member is detachably attached to the mount, the cover member covering an upper side of a front of the arm and a front side of an upper surface of the arm so that the cover member is capable of opening and closing the upper side of the front of the arm and the front side of the upper surface of the arm and wherein the spool holder being attached to the sewing machine by inserting the engagement part rearward from a front side of the sewing machine into the mount from which the cover member has been detached.

The disclosure further provides a sewing machine to which a spool holder on which a thread spool is placed is attached, the sewing machine including a mount to which is detachably attached a support provided on a rear end of a cover member covering an upper side of a front of the arm and a front side of an upper surface of the arm so that the cover member is capable of opening and closing the upper side of the front of the arm and the front side of the upper surface of the arm, wherein the spool holder is attached to the mount from which the cover member has been detached by inserting an engagement part of the sewing machine rearward from a front side of the sewing machine into the mount.

BRIEF DESCRIPTION OF THE DRAWINGS

In the accompanying drawings:

FIGS. 4A to 4F are a front view, a rear view, a left side view, a right side view, a plan view and a bottom view of the placement part respectively;

DETAILED DESCRIPTION

Figure 11:
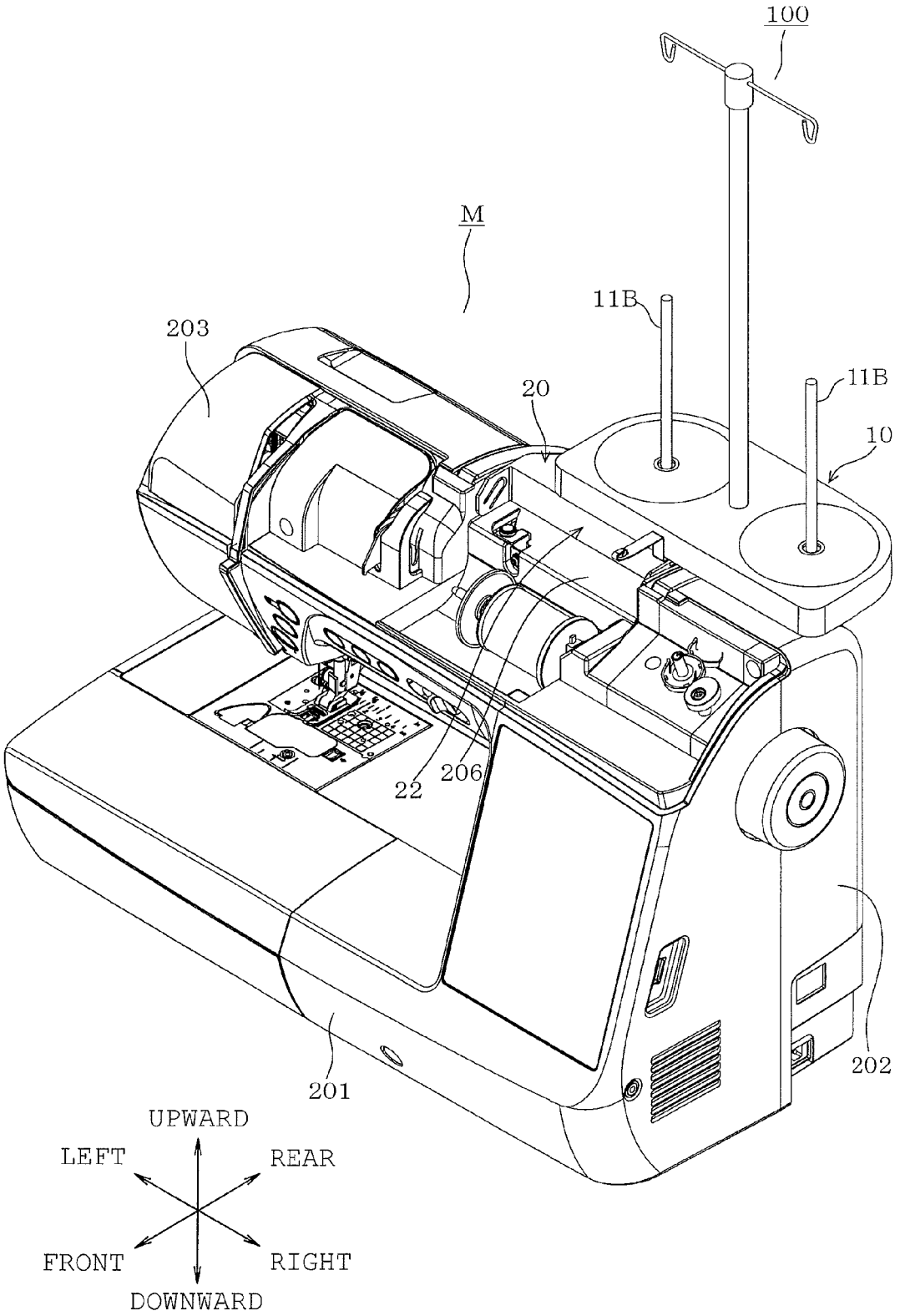
FIG. 11 is a perspective view of the sewing machine with the spool holder being attached thereto.
Figure 12:
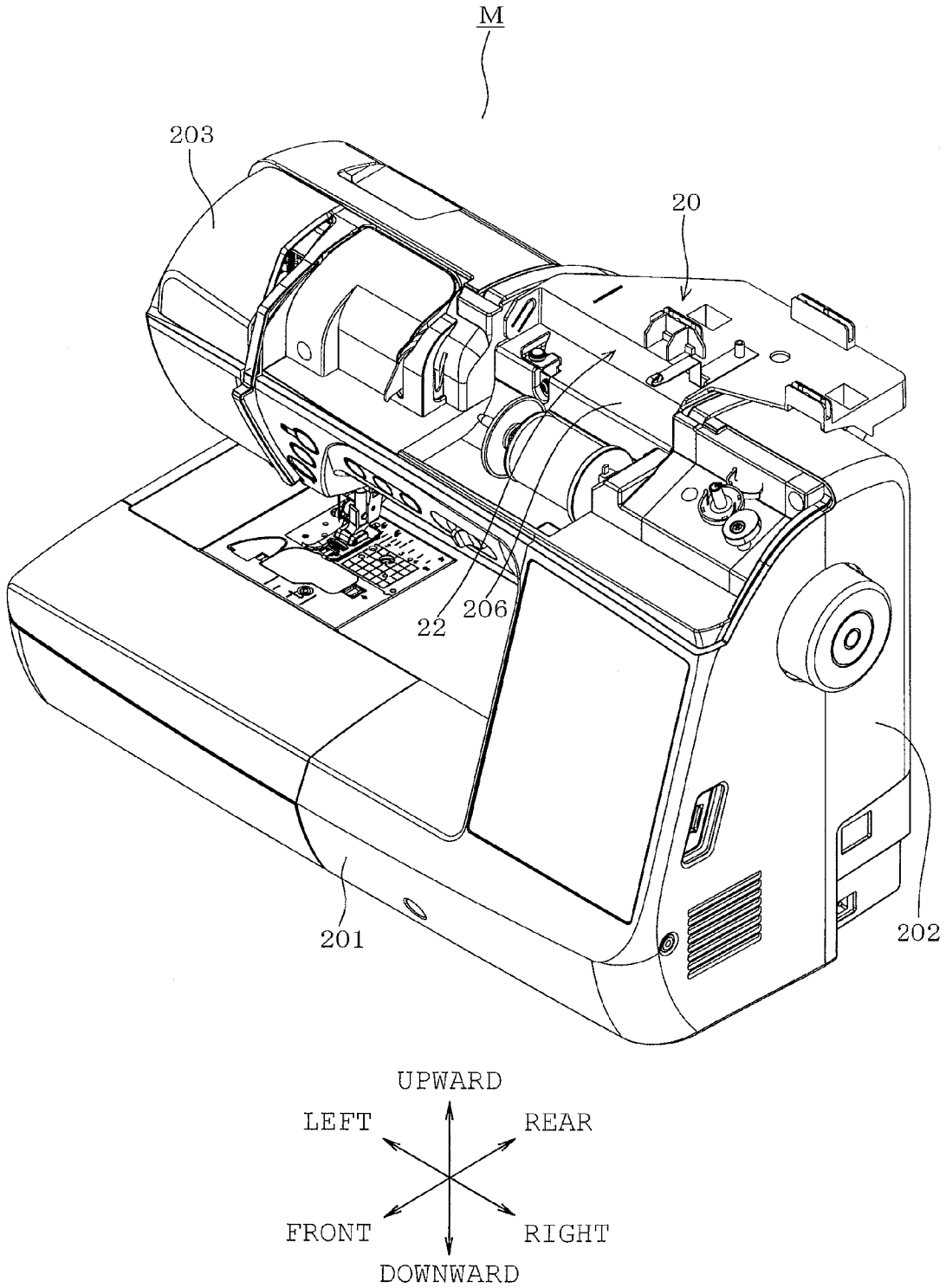
FIG. 12 is a perspective view of the sewing machine with the base being attached thereto.

An embodiment will be described with reference to the accompanying drawings. A spool holder 100 of the embodiment is detachably attached to a sewing machine M in use as shown in FIG. 11.

Describing the definition of direction in the embodiment, the side where a user is located in use of the sewing machine M (see FIG. 7, for example) which will be described in detail later will be referred to as "front" of the sewing machine M, and the side located opposite the front will be referred to as "rear." The left side as viewed from the user located in front of the sewing machine M will be referred to as "left," and the side located opposite the left will be referred to as "right." The upper side as viewed from the user located in front of the sewing machine M will be referred to as "upside," and the side located opposite the upside will be referred to as "downside." Further, the front-back direction, the right-left direction and the up-down direction of the spool holder 100 correspond to the front-back direction, the right-left direction and the up-down direction of the sewing machine M in the state where the spool holder 100 is attached to the sewing machine M, respectively.

Figure 1:
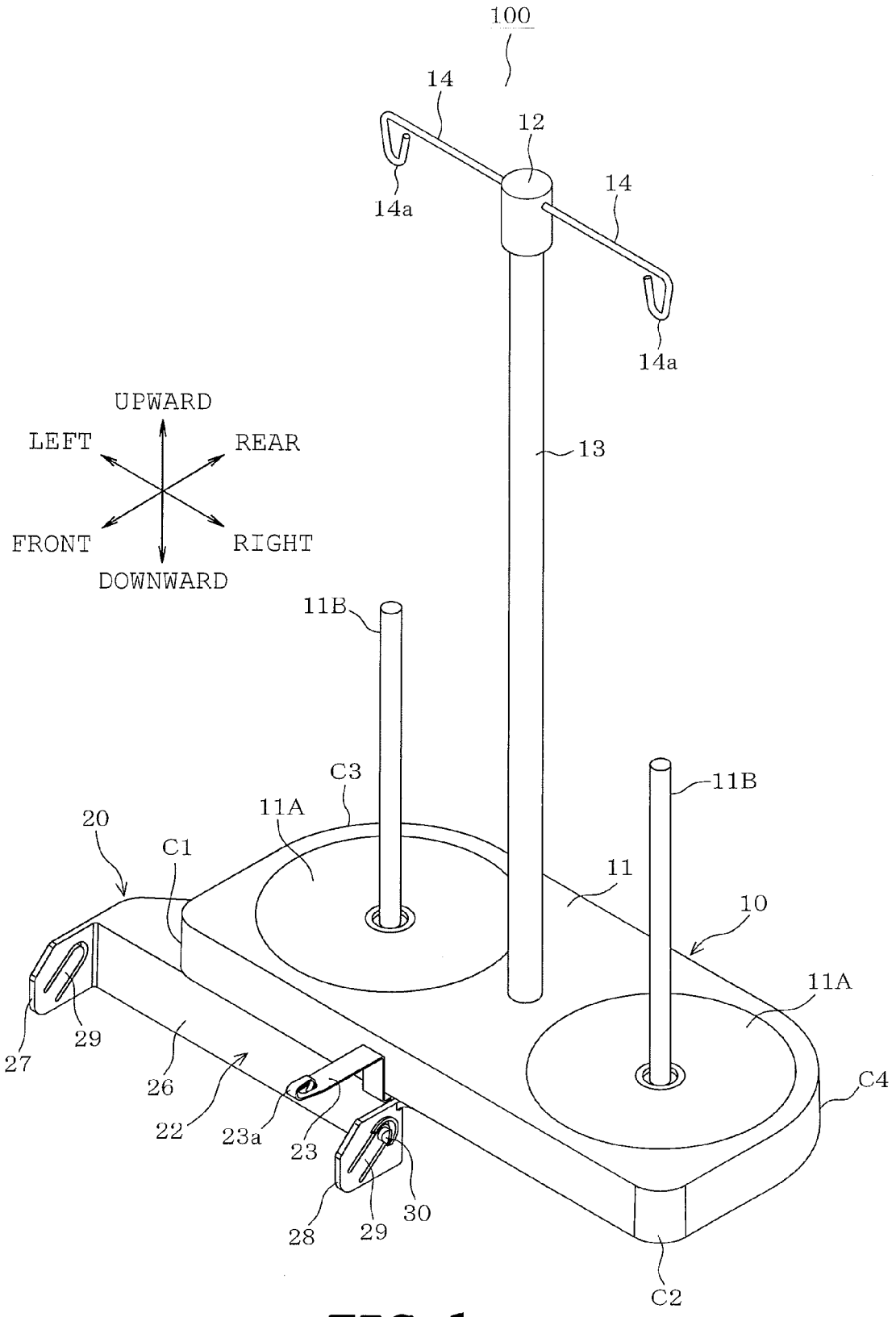
FIG. 1 is a perspective view of a spool holder according to an embodiment.
Figure 2B:
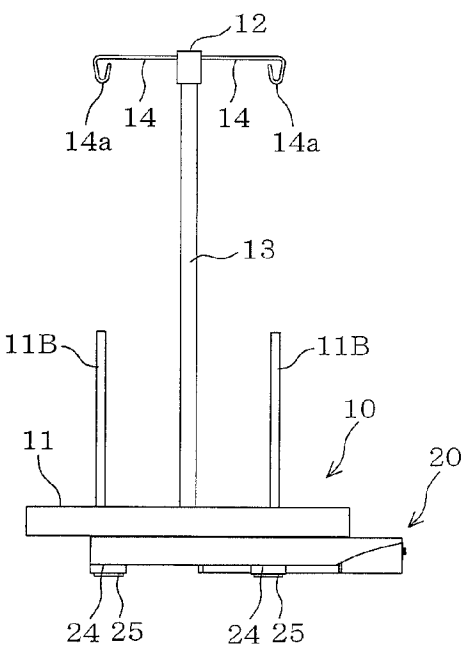
FIGS. 2A to 2F are a front view, a rear view, a left side view, a right side view, a plan view and a bottom view of the spool holder respectively.
Figure 2D:
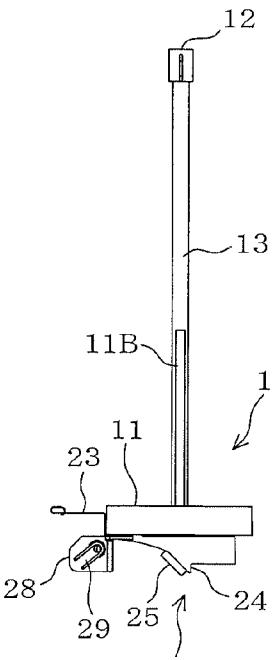
Figure 2A:
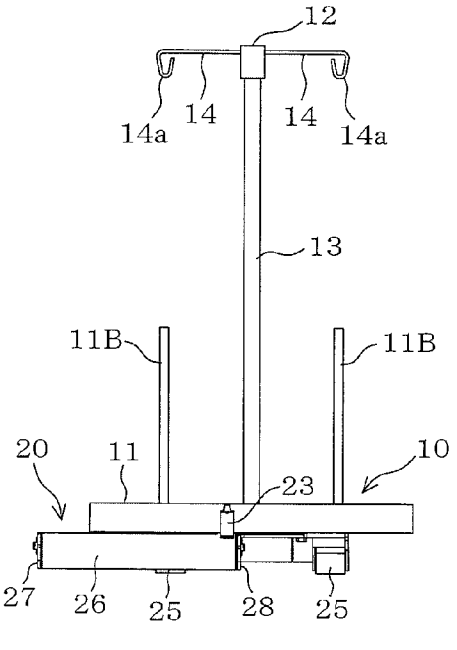
Figure 2C:
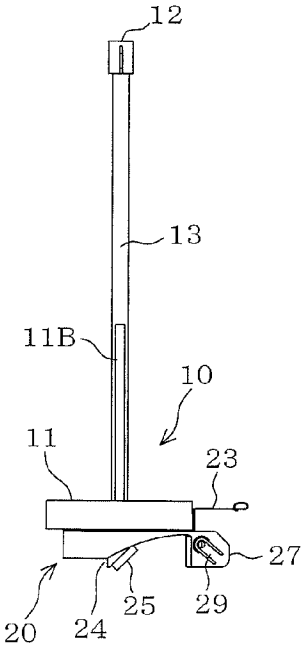
Figure 2E:
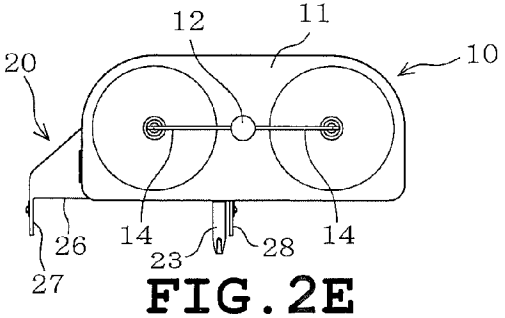
Figure 2F:
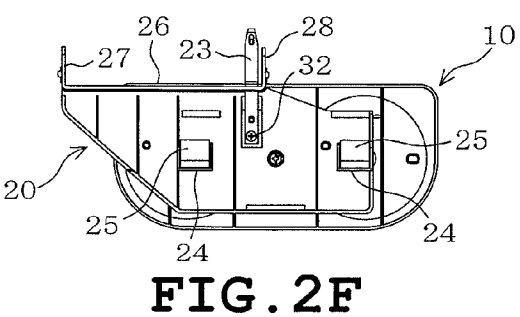
Figure 3:
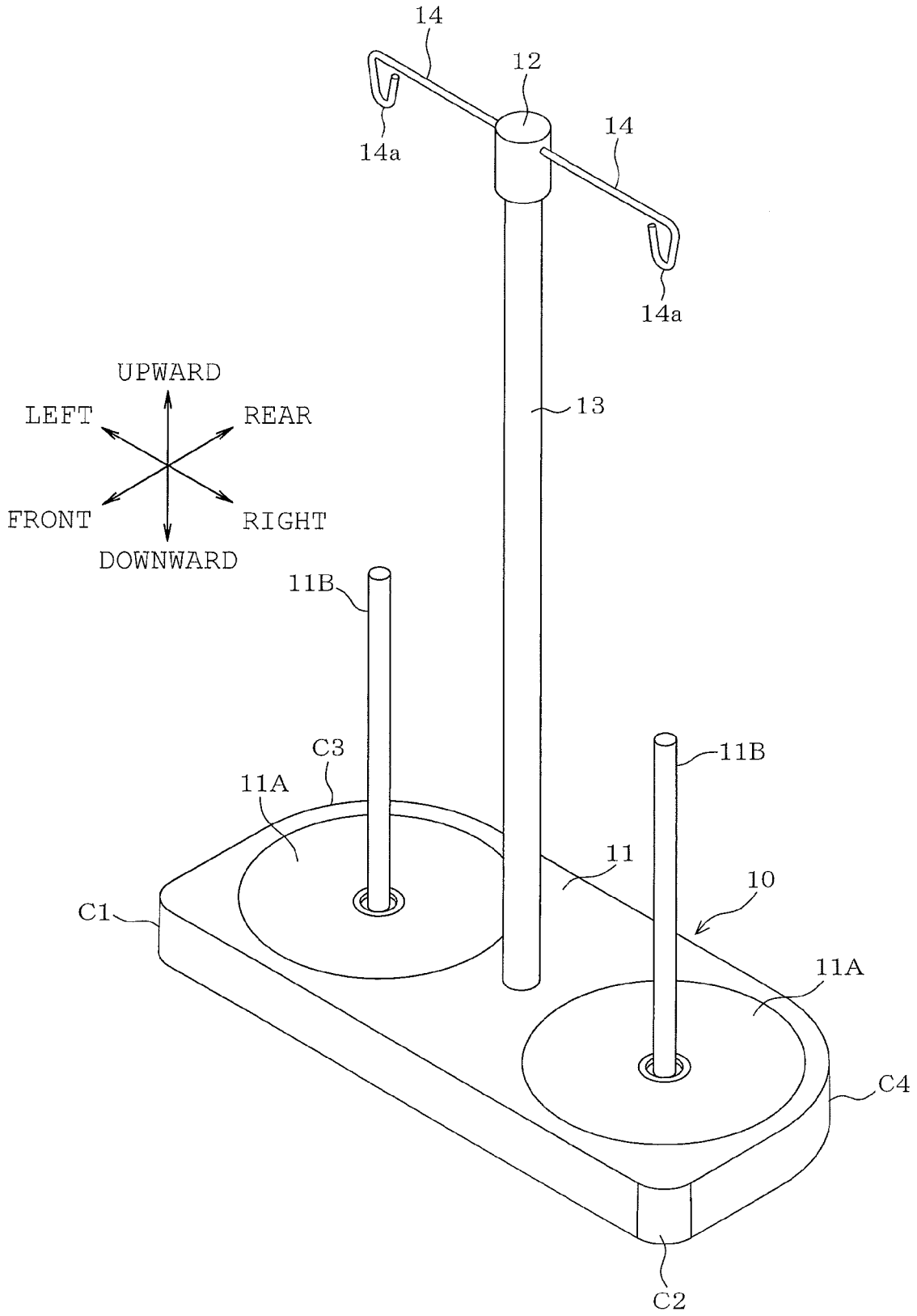
FIG. 3 is a perspective view of a placement part.
Figure 5:
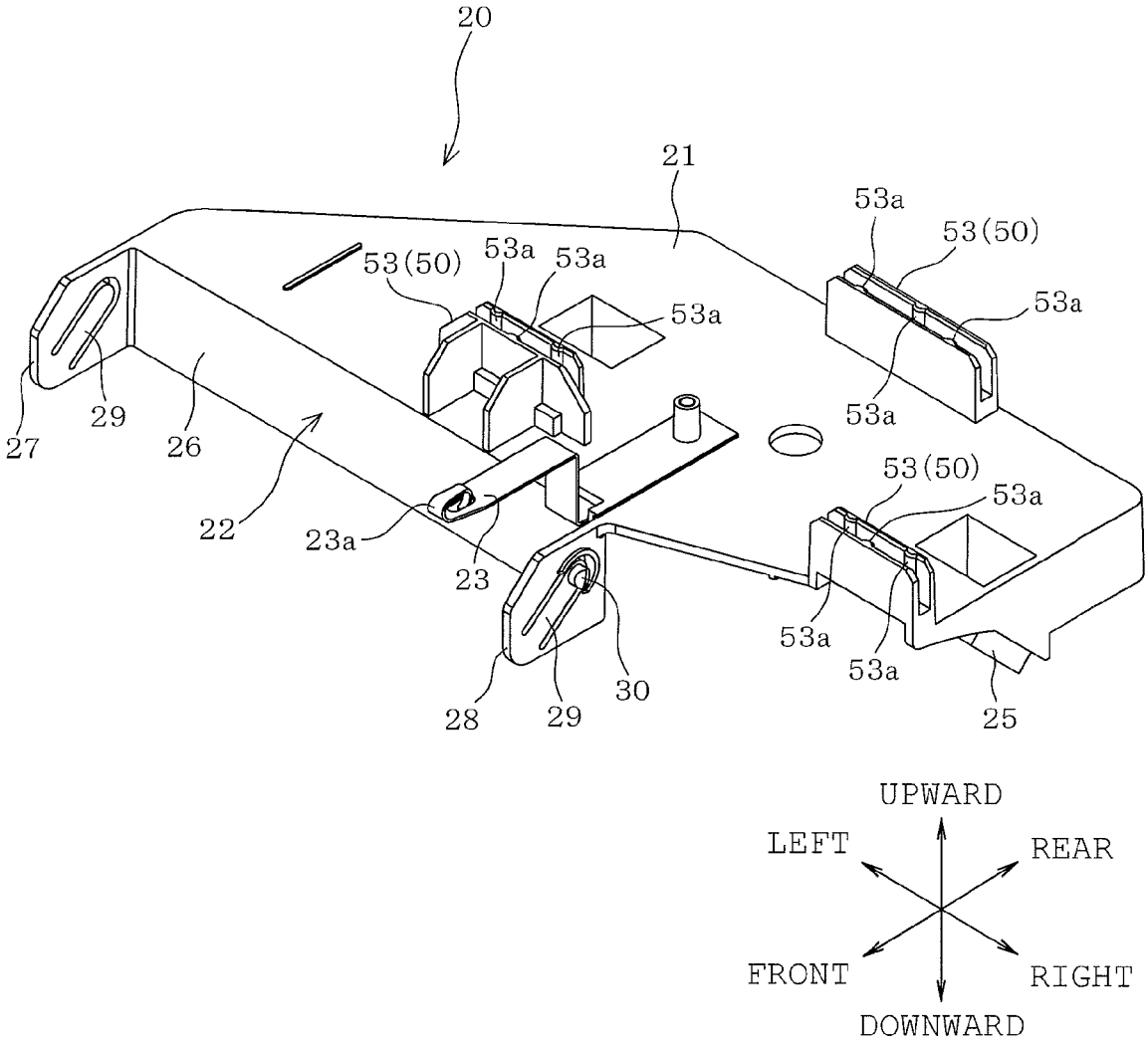
FIG. 5 is a perspective view of a base.

Referring to FIGS. 1 and 2, the spool holder 100 includes a placement part 10 and a base 20. The placement part 10 includes a placement plate 11 and a thread guide member 12 as shown in FIGS. 3 and 4A to 4F. The placement plate 11 is made of a resin material and formed into the shape of a flat plate having a predetermined thickness. The placement plate 11 has four corners C1 to C4 formed into an arc shape. The corners C2 and C1 located at the front right and left ends have a smaller roundness than the corners C4 and C3 located at the rear right and left ends. The placement plate 11 has an upper surface provided with two circular spool placement regions 11A on which thread spools (not shown) are to be placed respectively. The spool placement regions 11A are located at both sides of the placement plate 11 in the right-left direction. The spool placement regions 11A have central portions provided with spool pins 11B to support thread spools, respectively. The number of the spool placement regions 11A and the number of the spool pins should not be limited to two but may be one, three or more.

The thread guide member 12 includes a columnar part 13 and a thread guide 14. The columnar part 13 extends in the up-down direction and has a lower end fixed to a central portion of the placement plate 11 at a location interposed between the spool placement regions 11A. More specifically, the lower end of the columnar part 13 is fastened by a screw 15 from the underside of the placement plate 11 with the result that the columnar part 13 is fixed to the placement plate 11. The columnar part 13 has an upper end provided with two thread guides 14. The thread guides 14 are made of a wire rod and extend to the left side and the right side of the spool holder 100. The thread guides 14 have distal ends formed into thread passing parts 14*a* respectively. The thread passing parts 14*a* are located substantially directly above the spool pins 11B respectively. Threads (needle threads) drawn out of thread spools (not shown) placed on the spool placement regions 11A are inserted through the thread passing parts 14*a* respectively.

Figure 6B:
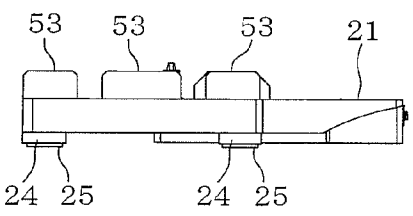
FIGS. 6A to 6F are a front view, a rear view, a left side view, a right side view, a plan view and a bottom view of the base respectively.
Figure 6D:
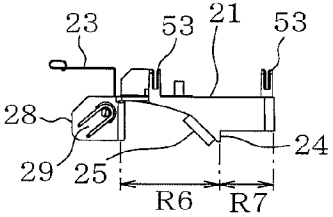
Figure 6E:
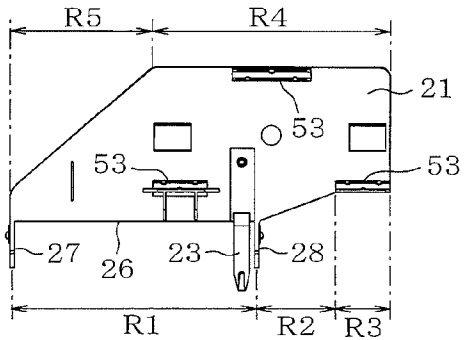
Figure 6A:
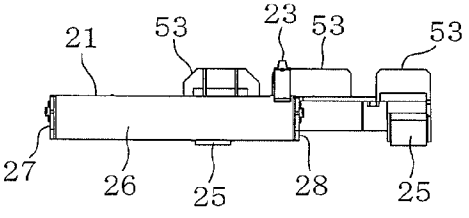
Figure 6C:
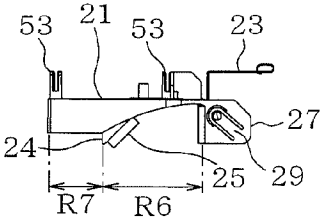
Figure 6F:
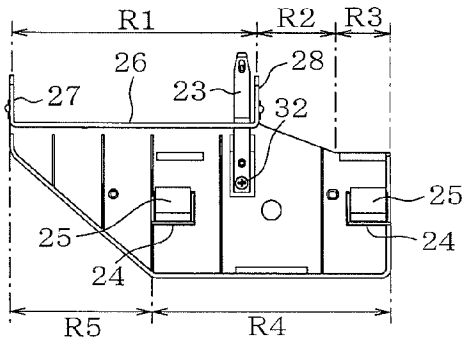

The base 20 includes a base plate 21, an engagement part 22 and a thread guide member 23 as shown in FIGS. 5 and 6A to 6F. The base plate 21 is made of a resin material and formed into the shape of a plate having a thinner front side and a thicker rear side. The base plate 21 has a front end provided with a linear region R1, a slanted region R2 and a linear region R3 as shown in FIGS. 6E and 6F. The linear region R1 is located in a central part and a left part of the front end as viewed by the user positioned in front of the sewing machine M which will be described in detail later, extending linearly in the right-left direction. The slanted region R2 is continuous from the linear region R1 and is located in a right part of the front end relative to the central part and is slanted downward as the slanted region R2 extends rightward. The linear region R3 is continuous from the slanted region R2 and is located in a right part of the front end relative to the slanted region R2, extending linearly in the right-left direction. On the other hand, the base plate 21 has a rear end provided with a linear region R4 and a slanted region R5. The linear region R4 is located in a central part and a right part of the front end as viewed by the user positioned in front of the sewing machine M, extending linearly in the right-left direction. The slanted region R5 is continuous from the linear region R4 and is located in a left part of the front end relative to the central part and is slanted downward as the slanted region R5 extends leftward.

The base plate 21 includes a lower part provided with a curved region R6 and a linear region R7 as shown in FIGS. 6C and 6D. The curved region R6 extends from the front end to a substantially central part in the front-back direction and is formed into a shape such that the curved region R6 is gently curved downward as the curved region R6 extends to the rear side. The linear region R7 is continuous from the curved region and is located in the rear of the curved region R6, extending linearly in the front-back direction. The lower part of the base plate 21 is also provided with two protrusions 24 which protrude downward. The protrusions 24 have respective front surfaces gently curved according to the curved shape of the curved region R6. Elastic bodies 25 are secured to the front surfaces of the protrusions 24 respectively. The elastic bodies 25 are made of a relatively soft elastic material such as felt or rubber. The elastic bodies 25 abut against a surface of an exterior cover of the sewing machine M when the spool holder 100 is attached to the sewing machine M, as will be described in detail later. Thus, since the elastic bodies 25 are relatively soft, the surface of the exterior cover of the sewing machine M is prevented from being damaged when the spool holder 100 is attached to the sewing machine M. The elastic bodies 25 further suppress transmission to the spool holder 100 of vibration produced during a sewing operation of the sewing machine M. The number of the protrusions 24 and the number of the elastic bodies 25 should not be limited to two but may be one, three or more.

The engagement part 22 is provided on the front end of the base plate 21. More specifically, the engagement part 22 is formed substantially over an entire length of the linear region R1 of the front end of the base plate 21. The engagement part 22 includes a downwardly extending part 26 extending downward from the linear region R1 into a plate shape and two forward extending parts 27 and 28 extending forward from both ends of the downwardly extending part 26 in the right-left direction, so as to be formed into a plate shape. The forward extending parts 27 and 28 have front ends including slanted upper parts respectively. The forward extending parts 27 and 28 are bilaterally symmetric. A horizontal dimension between the forward extending parts 27 and 28 corresponds with a dimension between support pieces 207 and 208 of a cover member 204 which will be described in detail later. The forward extending parts 27 and 28 are provided with respective engagement claws 29.

The engagement claws 29 are formed to linearly extend from front lower parts (proximal ends) toward rear upper parts (distal ends) of the forward extending parts 27 and 28 respectively. The engagement claws 29 have distal ends formed with small columnar protrusions 30 respectively. The protrusion 30 of the left engagement claw 29 protrudes leftward, and the protrusion 30 of the right engagement claw 29 protrudes rightward. The distal ends of the engagement claws 29 provided with the protrusions 30 are elastically deformable in the right-left direction. The shape of distal ends of the protrusions 30 may appropriately be changed, for example, the distal ends of the protrusions 30 may be chamfered.

The thread guide member 23 is provided on the front end of the base plate 21. The thread guide member 23 is located on the left side of the right forward extending part 28 of the engagement part 22 in the right end of the linear region R1, so as to extend forward. The thread guide member 23 is made of a metal plate and includes a lengthwise middle part folded into a stepped shape, so that the thread guide member 23 has a difference in level between the proximal end side and the distal end side. The thread guide member 23 has a front end formed with a thread passing portion 23*a* folded into an annular shape in a side view. The proximal end of the thread guide member 23 is fastened by a screw 32 from the underside of the base plate 21 thereby to be fixed to the base plate 21. Threads (needle threads) drawn out of thread spools (not shown) placed on the respective spool placement regions 11A are inserted through the thread passing part 14*a* and then further through the thread passing part 23*a*. The threads (needle threads) having passed through the thread passing part 23*a* are supplied through a thread guide path of the sewing machine M to a needle hole (not shown) of a needle (not shown).

The above-described placement part 10 is detachably attached to the base 20 thus constructed. Next, a fixing mechanism 50 will be described. The fixing mechanism 50 is provided for fixing the placement part 10 to the base 20. Four first ribs 51 extending in the front-back direction are formed on the underside of the placement part 10 as shown in FIG. 4F. Three second ribs 52 extending in the right-left direction are formed between the first ribs 51 on the underside of the placement part 10. The central rib 52 in the right-left direction is located on the rear of a central portion of the placement part 10 in the front-back direction. The right and left second ribs 52 are located in front of the central portion of the placement part 10 in the front-back direction. The second ribs 52 are an example of placement part side fixing part.

The base 20 has an upper surface formed with three slits 53 extending in the right-left direction as shown in FIGS. 5 and 6A to 6E. Each slit 53 is defined by two plate-shaped portions in parallel in the right-left direction and formed by arranging the plate-shaped portions in the front-back direction with a slight gap therebetween. Each slit 53 has protrusions 53*a* formed on inner walls of the plate-shaped portions. More specifically, one protrusion 53*a* is formed on a substantially central portion of the inner wall of one plate-shaped portion in the right-left direction. Two protrusions 53*a* are formed near ends of the inner wall of the other plate-shaped portion in the right-left direction. The locations of the slits 53 correspond to the locations of the second ribs 52 of the placement part 10 respectively. More specifically, the central slit 53 in the right-left direction is located on the rear end of the upper surface of the base 20 and substantially in the middle of the linear region R4 in the right-left direction. The left slit 53 is located on the front upper surface of the base 20 and on the right portion of the linear region R1. The right slit 53 is located on the front end of the upper surface of the base 20 and on the linear region R3. The slits 53 are an example of a base side fixing part.

When the placement part 10 is attached to the base 20, the three second ribs 52 at the placement part 10 side are thrust between the plate-shaped portions of the slits 53 at the base 20 side so as to be fitted between the plate-shaped portions, respectively. As a result, the second ribs 52 are fitted between the plate-shaped portions while being held between the one protrusions 53*a* of the one plate-shaped portions and the two protrusions 53*a* of the other plate-shaped portions respectively, with the result that the placement part 10 is fixed to the base 20. Consequently, the placement part 10 is prevented from being easily detached from the base 20 even when subjected to a relatively weak external force. Thus, the right-left ribs 52 provided at the placement part 10 side and the slits 53 provided at the base 20 side form a fixing mechanism 50 for fixing the placement part 10 attached to the base 20 to the base 20. The spool holder 100 has three fixing mechanisms 50 each one of which includes one second rib 52 and one slit 53. The construction and location of the fixing mechanism 50 may appropriately be changed in practice. Further, the number of the fixing mechanisms 50 should not be limited to three. However, it is desirable that at least two fixing mechanisms 50 be provided in view of the sizes of the base 20 and the placement part 10.

Figure 7:
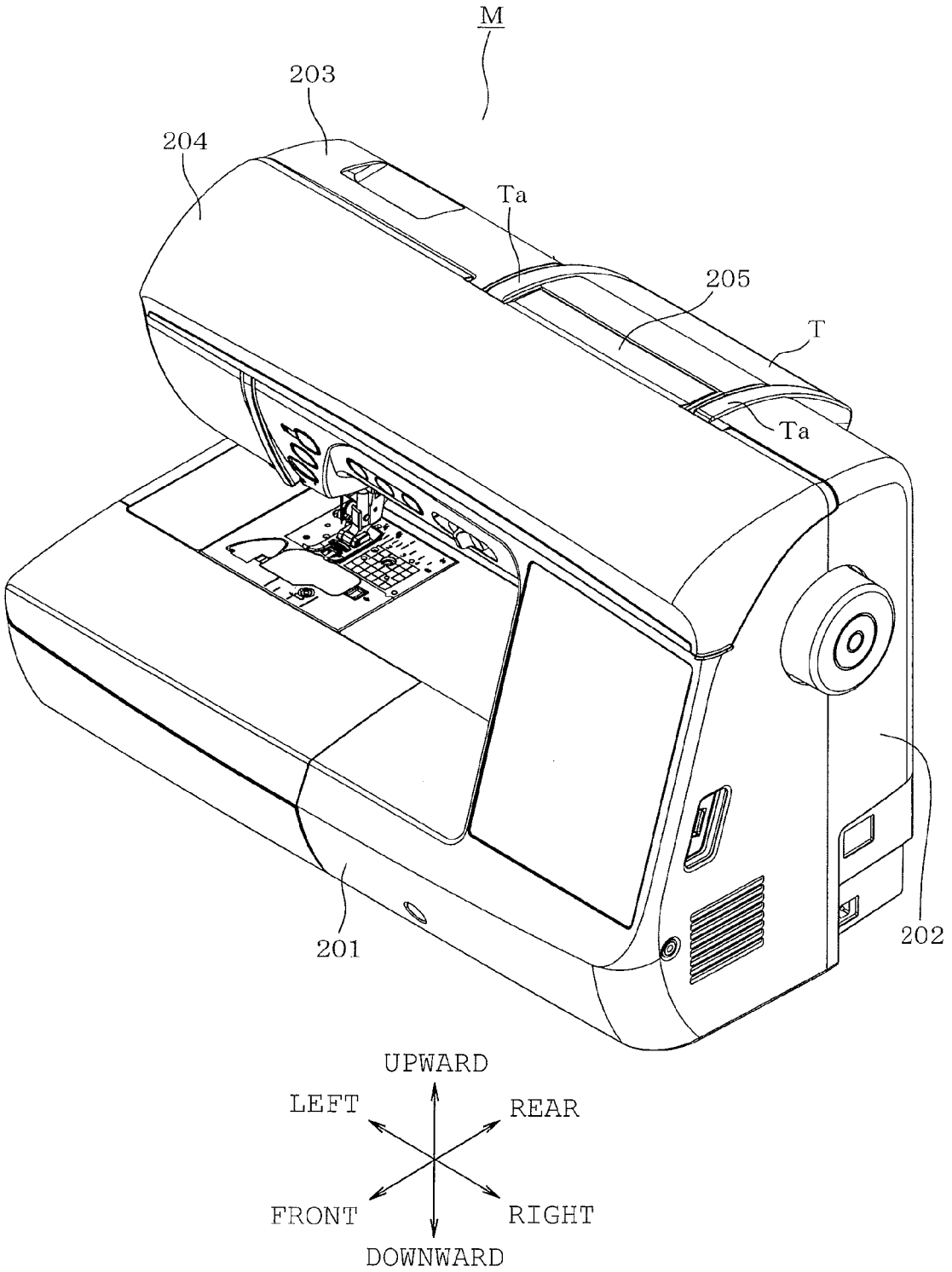
FIG. 7 is a perspective view of the sewing machine, showing a cover member located at a closing position.

The sewing machine M to which the foregoing spool holder 100 is detachably attached will be described. Referring to FIG. 7, the sewing machine M includes a bed 201, a pillar or standing part 202 extending upward from a right end of the bed 201 and an arm 203 extending leftward from the standing part 202. A cover member 204 which is long in the right-left direction is mounted to the arm 203. The cover member 204 covers an upper side of the front of the arm 203 and a front side of the upper surface of the arm 203 so that the cover member 204 is capable of opening and closing the upper side of the front of the arm 203 and the front side of the upper surface of the arm 203. The cover member 204 includes a support 205 which is provided on the rear end thereof and attached to a mount 206 so as to be detachable and rotatable, so that the cover member 204 is attached to the sewing machine M, as will be described in detail later.

Figure 8:
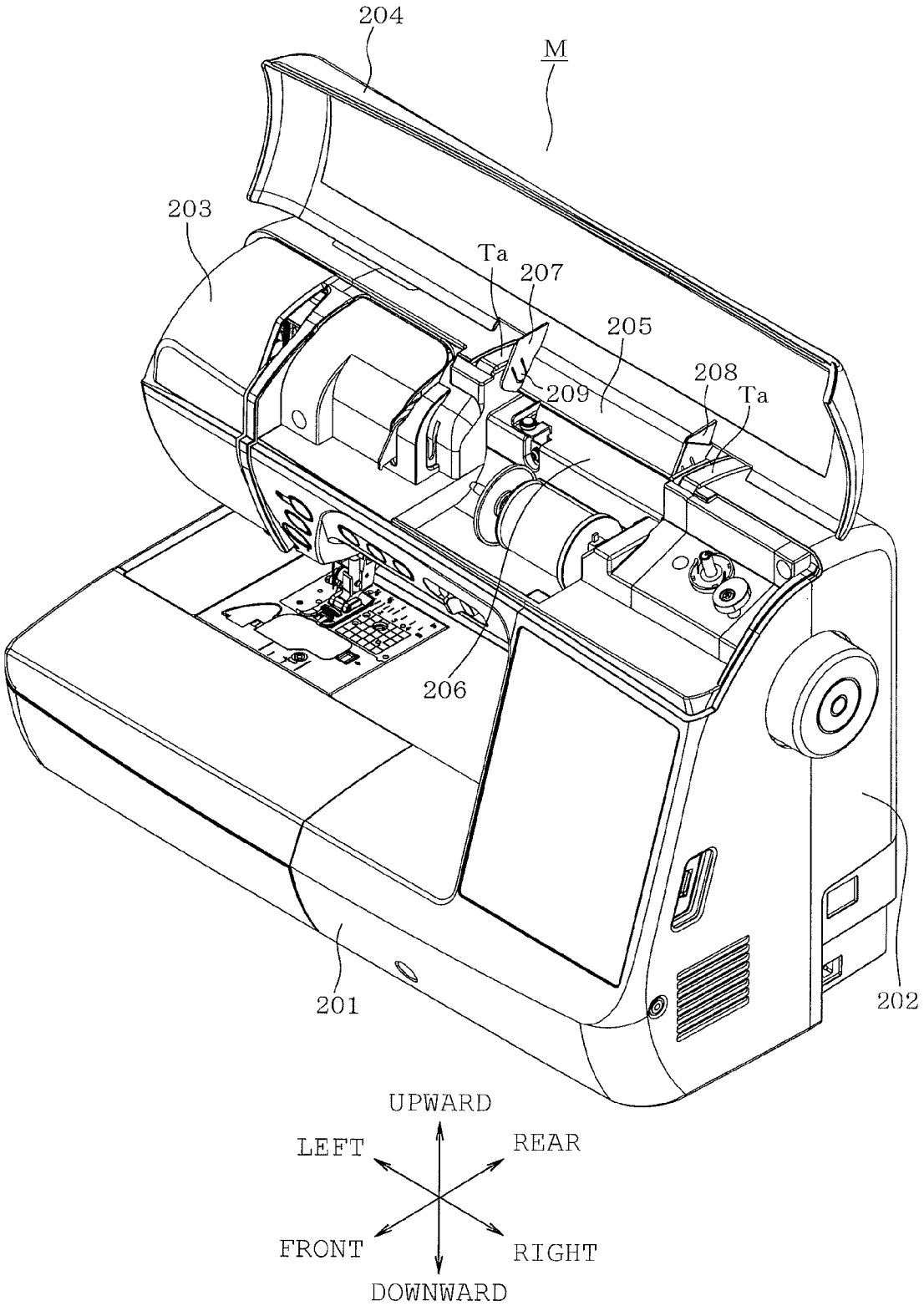
FIG. 8 is a perspective view of the sewing machine, showing the cover member located at an open position.

FIG. 7 shows the sewing machine M with the cover member 204 being closed, that is, the state where the cover member 204 covers the upper side of the front of the arm 203 and the front side of the upper surface of the arm 203. The position of the cover member 204 as shown in FIG. 7 will be referred to as "closing position." On the other hand, FIG. 8 shows the sewing machine M with the cover member 204 being open, that is, the state where the cover member 204 is open without covering the upper part of the front and the front part of the top of the arm 203. The position of the cover member as shown in FIG. 8 will be referred to as "open position."

A handle T includes a grip extending in a right-left direction and legs Ta extending frontward from right and left ends of the grip. The legs Ta are disposed at right and left sides of the mount 206 respectively. The legs Ta have front ends supported on a support shaft (not shown) fixed to a sewing machine frame and extending in the right-left direction so that the handle T is pivotable.

The support 205 of the cover member 204 has two support pieces 207 and 208. The right and left support pieces 208 and 207 are provided with respective engagement claws 209. The engagement claws 209 have the same shape as the engagement claws 29 provided on the respective forward extending parts 27 and 28 of the base plate 21. More specifically, when the cover member 204 is located at the closing position, the engagement claws 209 assume the shape linearly extending from the front lower portions (the proximal end) of the support pieces 207 and 208 toward the rear upper portions (the distal end) of the support pieces 207 and 208. The engagement claws 209 have distal ends formed with small cylindrical protrusions (not shown) respectively. The protrusion of the left engagement claw 209 protrudes leftward, and the protrusion of the right engagement claw 209 protrudes rightward. The distal ends of the engagement claws 209 formed with the respective protrusions are elastically deformable in the right-left direction. Distal ends of the protrusions may appropriately be changed in shape, for example, maybe chamfered.

The support pieces 207 and 208 are provided with locking respective protrusions (not shown). The locking protrusions are formed to protrude in the same direction as the protrusions of the respective engagement claws 209 protrude and further formed into a small semicircular shape.

Figure 9:
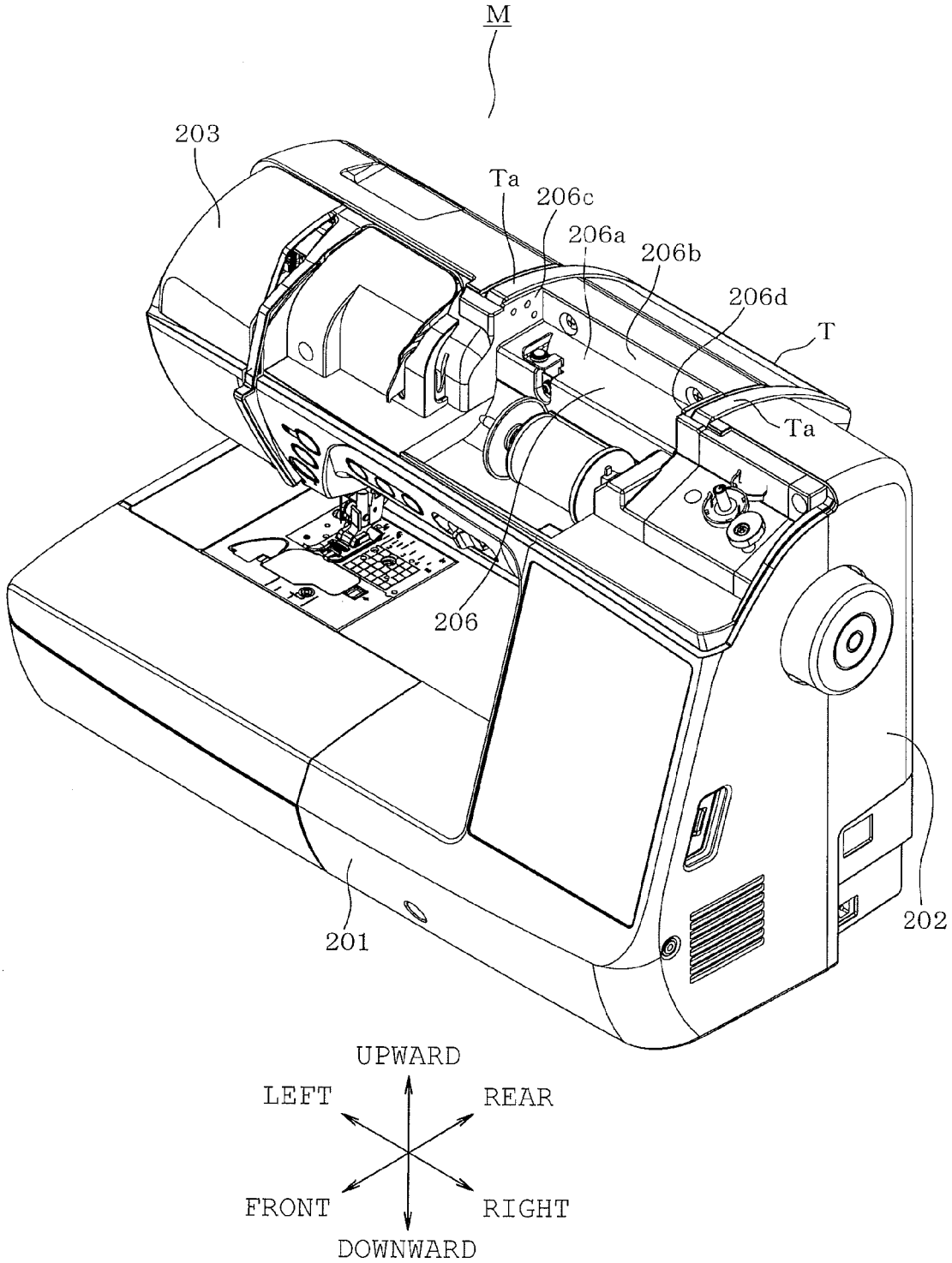
FIG. 9 is a perspective view of the sewing machine with the cover member or the spool holder being detached.
Figure 10:
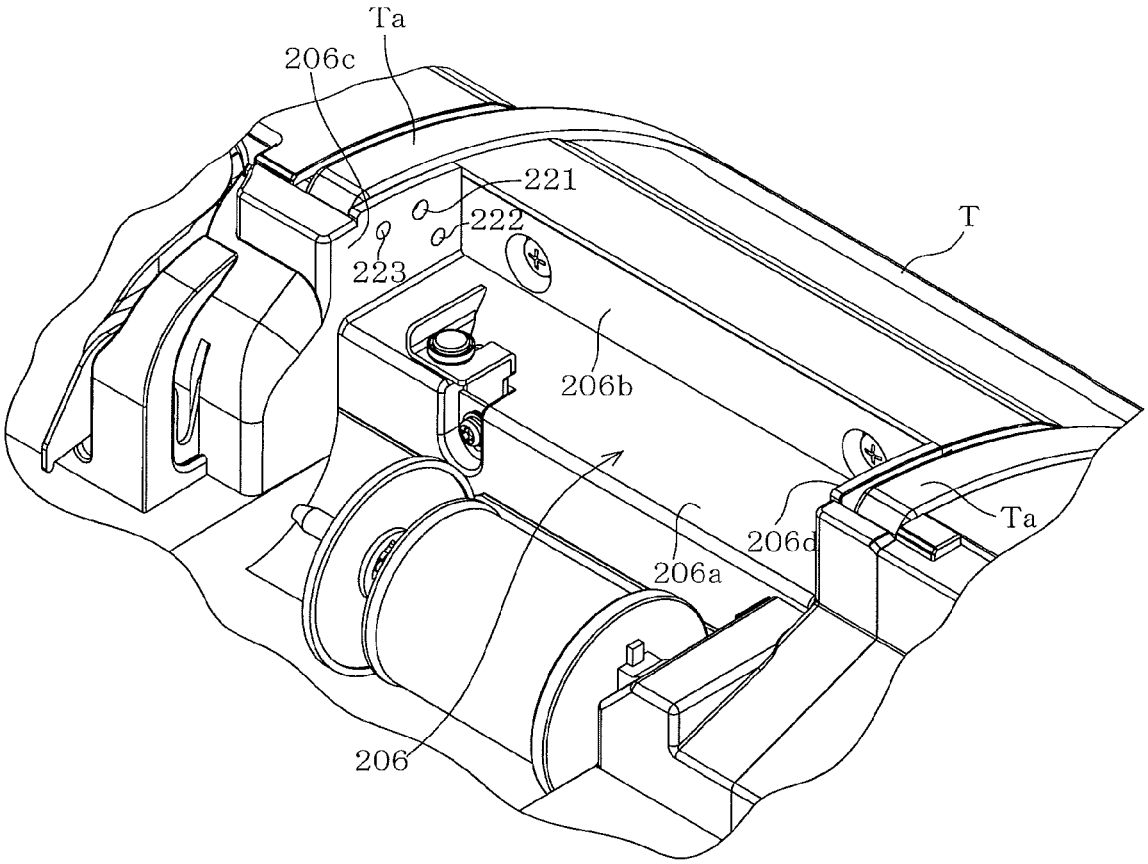
FIG. 10 is an enlarged perspective view of a mount and its periphery.

The construction of the mount 206 included in the arm 203 will be described. The mount 206 includes a horizontal surface 206*a*, a rear surface 206*b*, a left side surface 206*c* and a right side surface 206*d* as shown in FIGS. 9 and 10. The horizontal surface 206*a* extends horizontally in the right-left direction. The rear surface 206*b* extends perpendicularly upward from a rear end of the horizontal surface 206*a*. The left side surface 206*c* extends from left ends of the horizontal and rear surfaces 206*a* and 206*b* perpendicularly to the horizontal and rear surfaces 206*a* and 206*b*. The right side surface 206*d* extends from right ends of the horizontal and rear surfaces 206*a* and 206*b* perpendicularly to the horizontal and rear surfaces 206*a* and 206*b*. The mount 206 thus including the horizontal surface 206*a*, the rear surface 206*b*, the left side surface 206*c* and the right side surface 206*d* is formed into a substantially rectangular shape as a whole and has an open front and an open top.

Furthermore, the left side surface 206*c* is formed with three holes 221, 222 and 223 as shown in FIG. 10. The right side surface 206*d* is also formed with three holes although the holes are not shown in FIG. 10. The holes of the right side surface 206*d* are located to be bilaterally symmetrical to the holes 221 to 223 of the left side surface 206*c*. The support 205 of the cover member 204 is provided with protrusions which disengageably engage the holes 221 respectively. More specifically, the protrusions of the support 205 disengageably engage the respective holes 221 so that the support 205 is rotatably supported on the mount 206. Further, the locking protrusions of the right and left support pieces 208 and 207 are disengageably engageable with the holes 222 or the holes 223 respectively. More specifically, the locking protrusions engage the holes 222 respectively when the cover member 204 is located at the closing position. On the other hand, the locking protrusions engage the holes 223 respectively when the cover member 204 is located at the open position. The cover member 204 is held by a relatively weak force when the locking protrusions engage the holes 222 or 223 respectively. As a result, the cover member 204 is maintained in the closing position or the open position. Further, when the user applies a suitable external force to the cover member 204 while the cover member 204 is at the open position, the cover member 204 pivots from the open position to the closing position.

The following will describe operations to attach and detach the spool holder 100 to and from the sewing machine M. Firstly, the user detaches the cover member 204 from the arm 203 while being located in front of the sewing machine M. In this case, the mount 206 to which the support 205 of the cover member 204 is attached is substantially rectangular in shape and has the open front and the open top, as described above. In other words, the mount 206 is open to the user side as the user located in front of the sewing machine M views. Accordingly, when the user, while remaining in front of the sewing machine, operates the cover member 204 so that the cover member 204 is pulled out frontward, the engagement claws 209 are elastically deformed, so that the protrusions are disengaged from the respective holes 221. Thus, the support 205 can easily be released from the engagement with the mount 206. Consequently, the cover member 204 can easily be detached from the sewing machine M.

The user then attaches the spool holder 100 to the mount 206 from which the cover member 204 has been detached. In this case, the mount 206 is open to the user as he or she who is located in front of the sewing machine M views. Accordingly, the user remaining in front of the sewing machine M operates the spool holder 100 so that the engagement part 22 of the spool holder 100 is put backward from the front side of the sewing machine M into the mount 206. In this case, the engagement claws 29 remaining elastically deformed are moved backward. When the protrusions reach positions where the protrusions are engageable with the respective holes 221, the engagement claws 29 restore from the elastically deformed state to the former state, with the result that the protrusions engage the holes 221 respectively. Thus, the spool holder 100 can easily be attached to the sewing machine M. FIG. 11 shows the spool holder 100 attached to the sewing machine M. The spool holder 100 has the curved region R6 in the lower part thereof. When the spool holder 100 is to be attached to the sewing machine M, it is better that the spool holder 100 is moved backward from the front side while being inclined slightly to the front side. The spool holder 100 is finally attached to the sewing machine M so as to overlay from above. As a result, the spool holder 100 can be moved backward while going over the bulge of the rear upper surface of the arm 203.

On the other hand, when the spool holder 100 is to be detached from the sewing machine M, the user, while being located in front of the sewing machine M, operates the spool holder 100 to move the spool holder 100 to the front side, that is, to the side where the mount 206 is open and pulls out the engagement part 22 of the spool holder 100 detachably engaging the mount 206 frontward from the front side of the sewing machine M. As a result, the engagement part 22 can easily be released from engagement with the mount 206, and accordingly, the spool holder 100 can easily be detached from the sewing machine M. When the spool holder 100 is detached from the sewing machine M, it is better that the spool holder 100 is moved forward from the front side while being inclined slightly to the front side. As a result, the spool holder 100 can be moved frontward while going over the bulge of the rear upper surface of the arm 203, so that the detachment of the spool holder 100 can smoothly be carried out.

According to the foregoing embodiment, the user detaches the cover member 204 from the mount 206 provided on the arm 203 of the sewing machine M and puts the engagement part 22 of the spool holder 100 backward from the front side of the sewing machine M into the mount 206 from which the cover member 204 has been detached, with the result that the spool holder 100 can easily be attached to the sewing machine M. Further, the spool holder 100 can easily be detached from the sewing machine M by pulling out the engagement part 22 of the spool holder 100 attached to the sewing machine M forward from the front side of the sewing machine M. According to the above-described construction, the user can attach and detach the spool holder 100 to and from the sewing machine M while being located at the front side of the sewing machine M. This can improve the operability in attachment and detachment of the spool holder 100 to and from the sewing machine M.

Further, the spool holder 100 includes the placement part 10 on which at least one thread spool is placed and the base 20 to which the placement part 10 is detachably attached. The engagement part 22 disengageably engaging the mount 206 provided on the arm 203 of the sewing machine M is provided on the base 20. The sewing machine M involves a plurality of types of sewing machines. The mount 206 differs in the shape and the size among the types. More specifically, the base 20 having the engagement part 22 is specific depending upon the type of the sewing machine M. On the other hand, since the placement part 10 is configured to be detachably attachable to the base 20, the shape and the size of the placement part 10 and the number of thread spools which can be placed on the placement part 10 and the like can appropriately be changed. More specifically, the spool holder 100 of the embodiment is configured so that the specific base 20 according to the type of the sewing machine M is combined with the placement part 10 which is appropriately changeable irrespective of the type of the sewing machine M as an object on which the spool holder is to be attached. Accordingly, the spool holder 100 can easily be applied to the type of the sewing machine M owned by the user, and the placement part having the construction the user desires can easily be combined.

Further, the second ribs 52 provided on the placement part 10 and the slits 53 formed in the base 20 and the like constitute the fixing mechanism 50 for fixing the placement part 10 attached to the base 20 to the base 20. As a result, the spool holder 100 comprising two members of the placement part 10 and the base 20 can be handled integrally with the result that the usability of the spool holder can be improved. Further, the spool holder 100 can be avoided from unintentional separation of the spool holder to the placement part 10 and the base 20 during execution of the sewing operation or the like.

Further, the mount 206 has the holes 221 the supports 205 of the cover member 204 engage respectively. The engagement part 22 has the protrusions 30 engageable with the respective holes 221. Consequently, the engagement of the engagement part 22 with the mount 206 can be realized by a simple construction.

The foregoing embodiment should not be restrictive but may be modified or expanded. The spool holder 100 may be attached to the sewing machine M by attaching the base 20 to the mount 206 of the sewing machine M and thereafter attaching the placement part 10 to the base 20.

The fixing mechanism 50 may include the slits at the placement part 10 side and the ribs at the base 20 side. The fixing mechanism 50 should not be limited to the construction of fixing by the fitting of the ribs in the slits. For example, the fixing mechanism may include pins provided on one of the placement part 10 and the base 20 and pin holes formed in the other and may fix by inserting the pins into the respective pin holes. The fixing mechanism 50 may further fix the placement part 10 attached to the base 20 to the base 20 by the screwing, for example. Thus, the fixing mechanism 50 may employ various constructions that can fix the placement part 10 attached to the base 20 to the base 20.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

I claim:

1. A spool holder on which a thread spool is placeable, comprising:

an engagement part detachably engaging a mount which is provided on an arm of a sewing machine, wherein a support provided on a rear end of a cover member is detachably attached to the mount, the cover member covering an upper side of a front of the arm and a front side of an upper surface of the arm so that the cover member is capable of opening and closing the upper side of the front of the arm and the front side of the upper surface of the arm; and wherein the spool holder being attached to the sewing machine by inserting the engagement part rearward from a front side of the sewing machine into the mount from which the cover member has been detached.

2. The spool holder according to claim 1, further comprising:

a placement part on which at least one thread spool is placed;

a base to which the placement part is detachably attached, wherein the engagement part is provided on the base.

3. The spool holder according to claim 2, further comprising:

a placement part side fixing part provided on the placement part;

a base side fixing part provided on the base;

a fixing mechanism including the placement side fixing part and the base side fixing part and fixing the placement part attached to the base to the base.

4. The spool holder according to claim 1, wherein the mount has a hole with which the support of the cover member engages, the spool holder further comprising a protrusion provided on the engagement part and disengageably engageable with the hole.

5. The spool holder according to claim 2, further comprising at least one thread guide member guiding a thread supplied from the thread spool placed on the placement part.

6. A sewing machine comprising:

a spool holder on which a thread spool is placeable, the spool holder including:

an engagement part detachably engaging a mount which is provided on an arm of a sewing machine, wherein a support provided on a rear end of a cover member is detachably attached to the mount, the cover member covering an upper side of a front of the arm and a front side of an upper surface of the arm so that the cover member is capable of opening and closing the upper side of the front of the arm and the front side of the upper surface of the arm; and wherein the spool holder being attached to the sewing machine by inserting the engagement part rearward from a front side of the sewing machine into the mount from which the cover member has been detached.

7. A sewing machine to which a spool holder on which a thread spool is placed is attached, the sewing machine comprising:

a mount to which is detachably attached a support provided on a rear end of a cover member covering an upper side of a front of the arm and a front side of an upper surface of the arm so that the cover member is capable of opening and closing the upper side of the front of the arm and the front side of the upper surface of the arm, wherein the spool holder is attached to the mount from which the cover member has been detached by inserting an engagement part of the spool holder rearward from a front side of the sewing machine into the mount.

* * * * *